US011560992B1

(12) United States Patent
Lin

(10) Patent No.: US 11,560,992 B1
(45) Date of Patent: Jan. 24, 2023

(54) ELECTRONIC CANDLE

(71) Applicant: Mao-Lung Lin, New Taipei (TW)

(72) Inventor: Mao-Lung Lin, New Taipei (TW)

( * ) Notice: Subject to any disclaimer, the term of this patent is extended or adjusted under 35 U.S.C. 154(b) by 0 days.

(21) Appl. No.: 17/562,091

(22) Filed: Dec. 27, 2021

(30) Foreign Application Priority Data

Sep. 15, 2021 (CN) ..... 202122241667.9

(51) Int. Cl.
*F21S 10/04* (2006.01)

(52) U.S. Cl.
CPC ..... *F21S 10/046* (2013.01)

(58) Field of Classification Search
CPC ..... F21S 10/04; F21S 10/046
See application file for complete search history.

(56) References Cited

U.S. PATENT DOCUMENTS 9,885,452 B2 * 2/2018 Yuan ..... F21V 23/006
2014/0211499 A1 * 7/2014 Fong ..... H05B 45/00
362/558

* cited by examiner

*Primary Examiner* — Robert J May
(74) *Attorney, Agent, or Firm* — Juan Carlos A. Marquez; Marquez IP Law Office, PLLC

(57) ABSTRACT

An electronic candle includes a casing, a light source, a driving component, a swinging support member, and a flame head. The casing has a mounting cavity, where the light source and the driving component are mounted, and is provided at the upper end with an opening communicating with the mounting cavity. The light source is right below the opening and projects light on the flame head, which is mounted, and can swing freely, on the light source and at least partially extends out of the opening. The driving component can drive the swinging support member to swing, thereby driving the flame head, which is connected to the swinging support member, to swing freely with respect to the light source. With the swinging support member intermittently driven by the driving component and swinging freely under gravity during the undriven intervals, the flame head can swing dynamically to simulate a swinging flame.

9 Claims, 5 Drawing Sheets

ELECTRONIC CANDLE

BACKGROUND OF THE INVENTION

1. Technical Field

The present invention relates to the technical field of articles for daily use and more particularly to an electronic candle.

2. Description of Related Art

Since their invention, electronic candles, which are safe and convenient to use, energy-saving, and environmentally friendly, have gradually replaced the traditional ignitable cylindrical candles and become more and more popular, especially in Europe and the United states.

Existing electronic candles, though equipped with an electronic control circuit, are subject to limitations in function and fail to imitate the movement of candle flames with precision. Some electronic candles feature motor-driven rotation and use an eccentric wheel to control the swinging of a wick plate, but the resulting mechanical movement lacks spontaneity and produces poor simulation results: the simulated flame does not move as dynamically as a real one, and the flame head swings so stiffly that only a low degree of simulation is achieved. In short, existing electronic candles cannot satisfy consumers' increasing demand for quality.

BRIEF SUMMARY OF THE INVENTION

One objective of the present invention is to provide an electronic candle and thereby solve the aforesaid technical problem of existing electronic candles, namely the low degree of simulation resulting from the stiff and unnatural swinging mode of the flame head.

The present invention provides an electronic candle that includes a casing, a light source, a driving component, a swinging support member, and a flame head. The casing has a mounting cavity. The casing is provided at the upper end with an opening in communication with the mounting cavity. The light source and the driving component are both mounted in the mounting cavity, with the light source located right below the opening. The flame head is mounted on the light source in a movable manner and can swing freely on a supporting end provided or defined by the light source. The flame head at least partially extends out of the opening. The swinging support member and the flame head are connected to each other. The driving component is configured to drive the swinging support member into a swinging motion and thereby drive the flame head to swing freely on the light source.

Compared with the prior art, the electronic candle of the present invention has at least the following technical effects:

The light emitted by the light source is projected on the flame head. The driving component drives the swinging support member into a swinging motion intermittently. During the intervals in which the swinging support member is not driven by driving component, the swinging support member swings freely due to the gravitational force acting on itself and thereby drives the flame head to swing freely on the light source. The flame head, therefore, can swing in a natural and dynamic manner, producing a visual effect that simulates a swinging flame with a high degree of simulation.

BRIEF DESCRIPTION OF THE SEVERAL VIEWS OF THE DRAWINGS

The structure and the technical means adopted by the present invention to achieve the above and other objects can be best understood by referring to the following detailed description of the preferred embodiments and the accompanying drawings, wherein.

Figure 1:
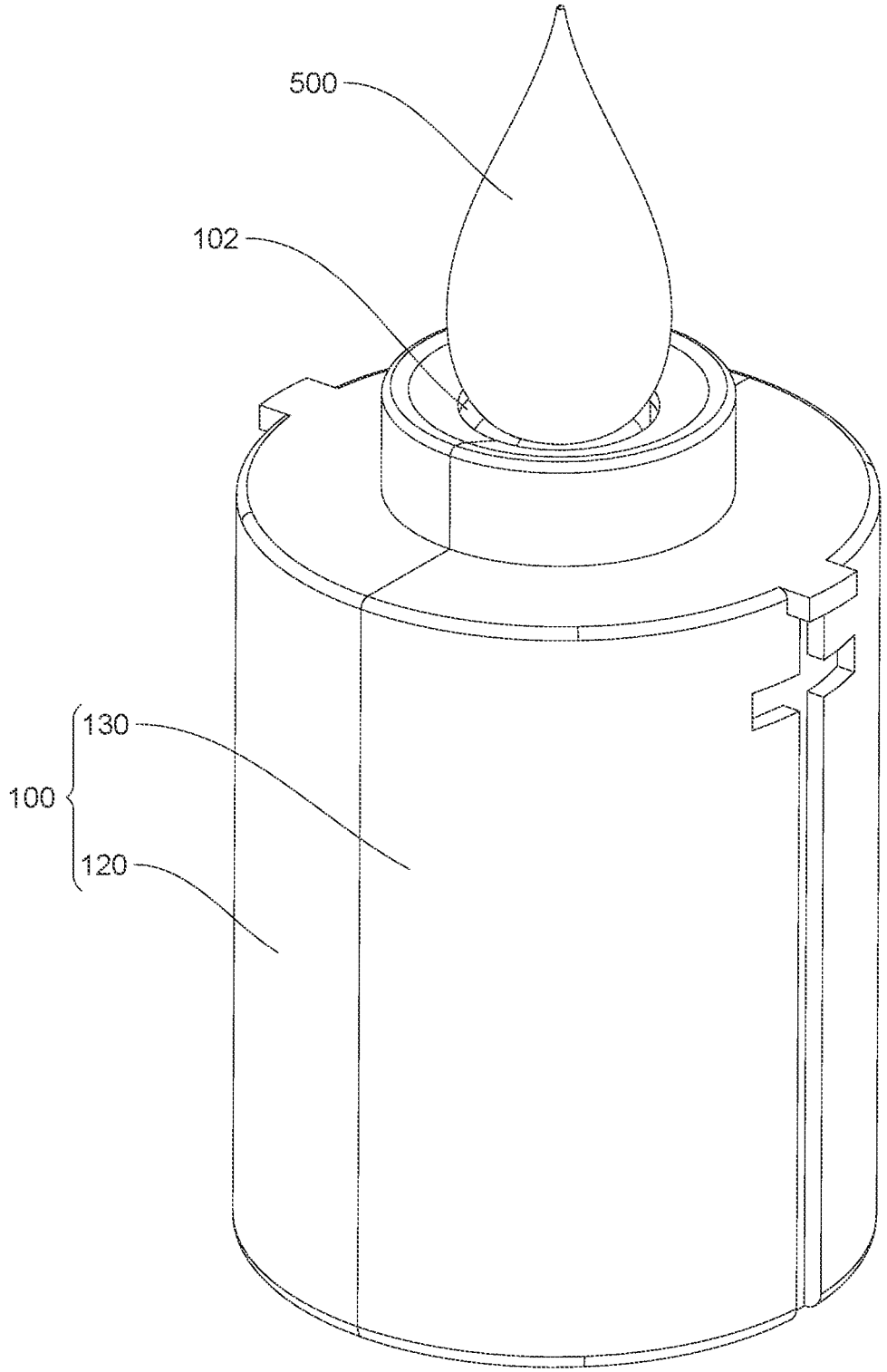
FIG. 1 is a perspective view showing the structure of an electronic candle according to the present invention.

The reference numerals used in the drawings are explained as follows:

| | | | |
|---|---|---|---|
| 100 | Casing | 400 | Swinging support member |
| 101 | Mounting cavity | 410 | Counterweight block |
| 102 | Opening | 420 | To-be-drawn member |
| 110 | Connection post | 430 | Connecting portion |
| 111 | Insertion and connection hole | 431 | Clearance hole |
| 120 | First casing portion | 432 | Connection ring |
| 130 | Second casing portion | 500 | Flame head |
| 200 | Light source | 510 | Flame portion |
| 210 | Supporting end | 512 | Insertion groove |
| 220 | Support frame | 520 | Swinging portion |
| 221 | Insertion and connection post | 521 | Recessed portion |
| 300 | Driving component | 522 | Insertion post |
| 310 | Electromagnetic driving element | 600 | Electrical control device |

DETAILED DESCRIPTION OF THE INVENTION

A detailed description of some embodiments of the present invention is given below with reference to the accompanying drawings, in which identical or similar reference numerals represent the same element or similar elements or elements having identical or similar functions. The embodiments described below with reference to the accompanying drawings serve illustrative purposes only, and the following description is intended to expound the embodiments and should not be construed as restrictive of the invention.

It should be understood that in the following description of the disclosed embodiments of the present invention, the directions or positional relationships indicated by such terms as "length", "width", "upper", "lower", "front", "rear", "left", "right", "vertical", "horizontal", "top", "bottom", "inner", and "outer" are based on the directions or positional relationships shown in the accompanying drawings. Those terms are used only to facilitate and simplify description of the embodiments of the invention and do not indicate or suggest that the device or element to which such a term is applied must have a particular direction or be structured or operated in a particular direction. Those terms, therefore, should not be construed as restrictive of the invention.

In addition, terms such as "first" and "second" serve descriptive purposes only and should not be construed as indicating or suggesting relative importance or implying the number of the technical feature to which such a term is applied. Therefore, a feature defined as "first" or "second" may include, either explicitly or implicitly, one or more such features. Besides, in the following description of the disclosed embodiments of the present invention, "a plurality" connotes two or more than two, unless specifically defined otherwise.

Moreover, in the following description of the disclosed embodiments of the present invention, terms such as "mount", "connect to each other", "connect", and "fix" should be understood broadly, unless specifically set forth or defined otherwise. For example, such a term may refer to fixed connection, detachable connection, or being connected as a single unit; or refer to mechanical connection or electrical connection; or refer to being connected directly or through an intermediate medium; or refer to communication between the interior portions of two elements or an interaction between two elements. A person of ordinary skill in the art shall be able to understand the specific meanings of those terms in relation to the embodiments according to the context in which each term is used.

Referring to FIG. 1 to FIG. 5, one embodiment of the present invention provides an electronic candle that includes a casing 100, a light source 200, a driving component 300, a swinging support member 400, and a flame head 500.

Figure 2:
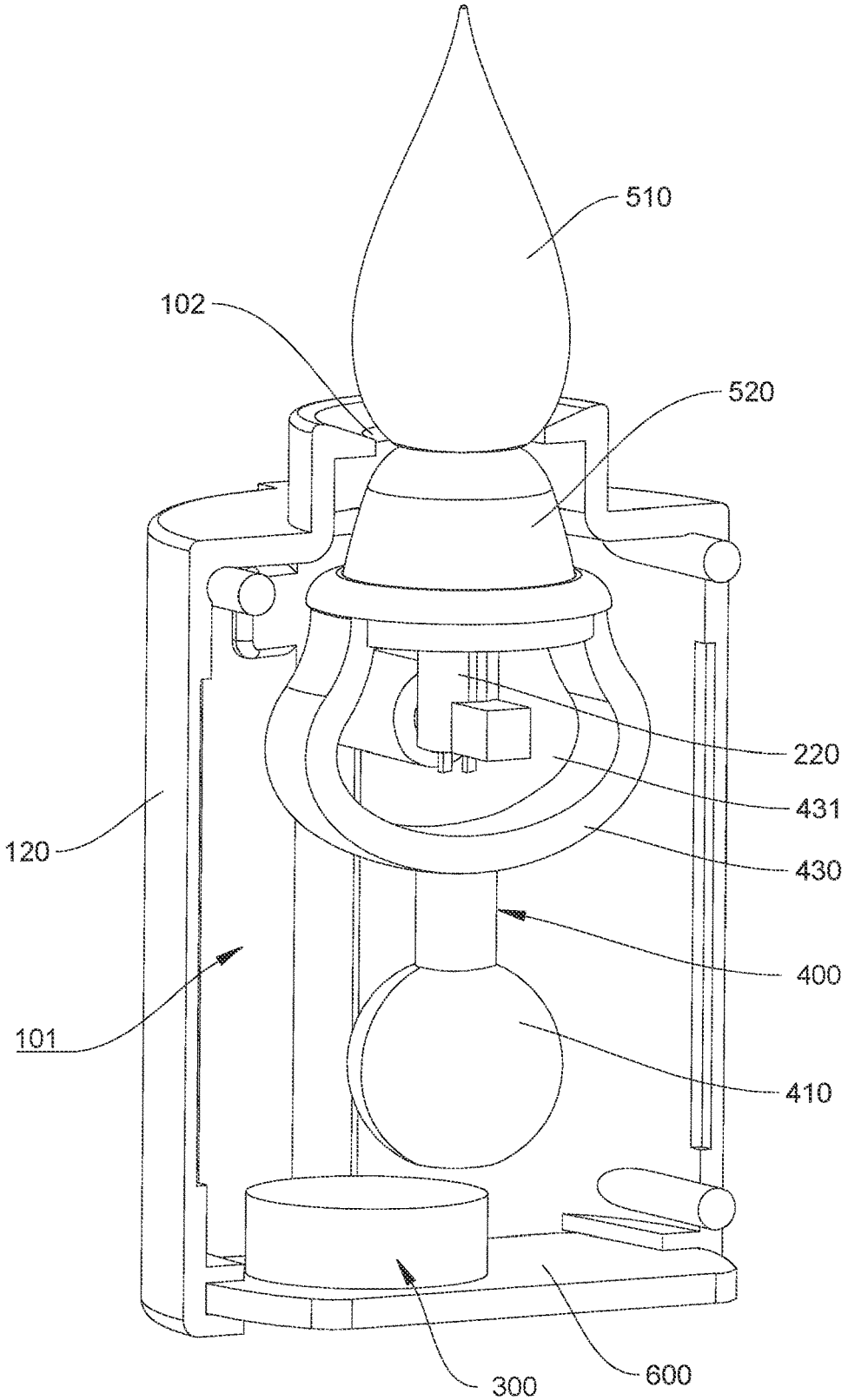
FIG. 2 is similar to FIG. 1 except that half of the casing of the electronic candle is omitted.

As shown in FIG. 1 and FIG. 2, the casing 100 has a mounting cavity 101, and the upper end of the casing 100 is provided with an opening 102 in communication with the mounting cavity 101.

Figure 3:
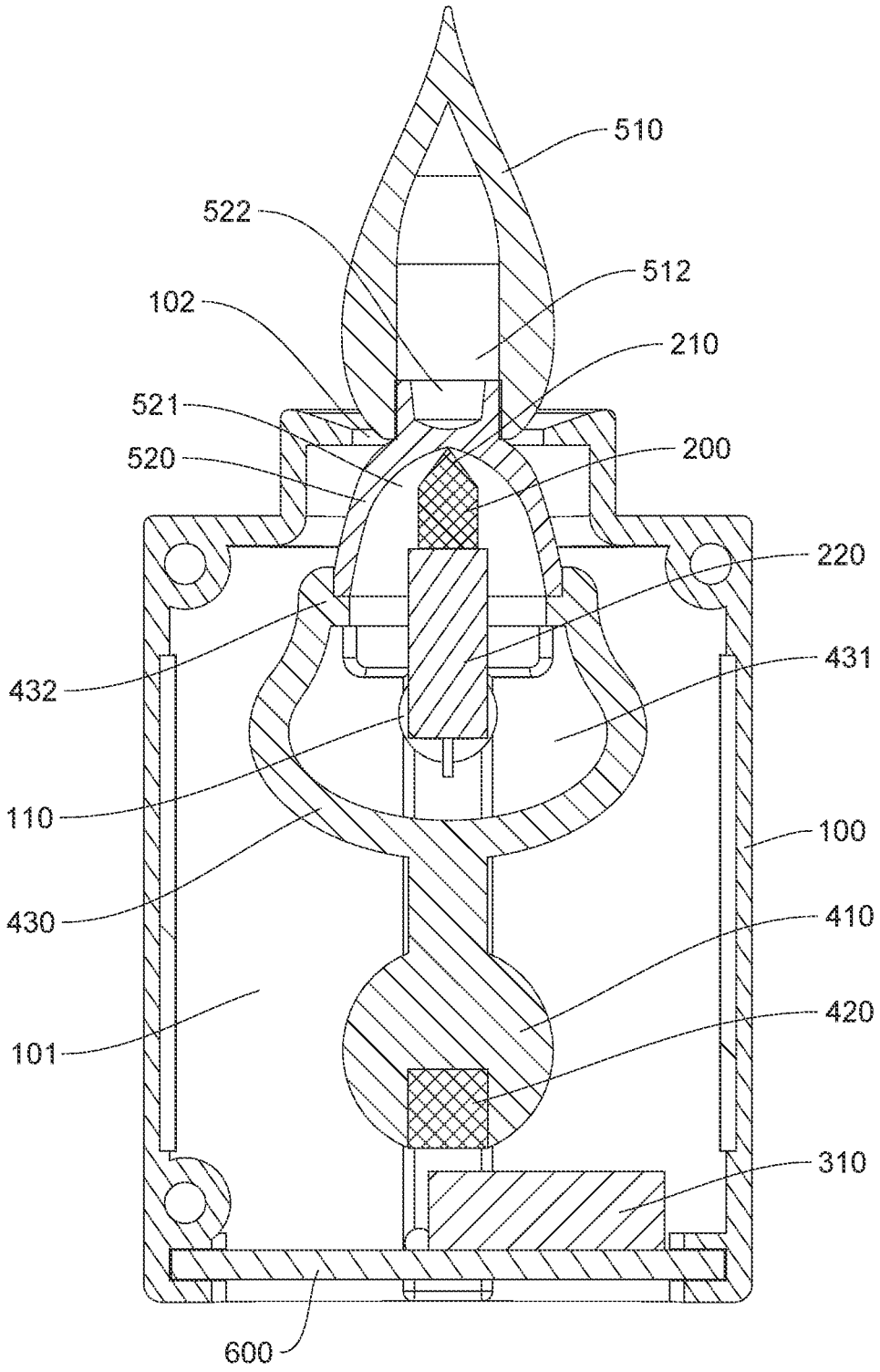
FIG. 3 is a sectional view of the electronic candle in FIG. 1.

As shown in FIG. 2 and FIG. 3, both the light source 200 and the driving component 300 are mounted in the mounting cavity 101, and the light source 200 is located directly below the opening 102.

As shown in FIG. 2 and FIG. 3, the flame head 500 is movably mounted on the light source 200 and can swing freely on a supporting end provided or defined by the light source 200. The light source 200 supports the flame head 500. The flame head 500 at least partially extends out of the opening 102 so as to be visible outside the casing 100.

It can be understood that, as shown in FIG. 2 and FIG. 3, there is a gap between the flame head 500 and the wall of the opening 102 so that the opening 102 will not interfere with the swinging of the flame head 500.

As shown in FIG. 2 and FIG. 3, the swinging support member 400 and the flame head 500 are connected to each other. The driving component 300 is configured to drive the swinging support member 400 into a swinging motion, in order for the swinging support member 400 to drive the flame head 500 to swing freely with respect to the light source 200.

The light source 200 is a light bead, and the light bead is preferably a light-emitting diode (LED) light, which is energy-saving and has a long service life.

As shown in FIG. 2 and FIG. 3, the light emitted by the light source 200 is projected on the flame head 500. The driving component 300 drives the swinging support member 400 into a swinging motion intermittently. During the intervals in which the swinging support member 400 is not driven by the driving component 300, the swinging support member 400 swings freely due to the gravitational force acting on itself and thereby drives the flame head 500 to swing freely on the light source 200. The flame head 500, therefore, can swing naturally and dynamically, producing a visual effect that simulates a swinging flame with a high degree of simulation.

Figure 4:
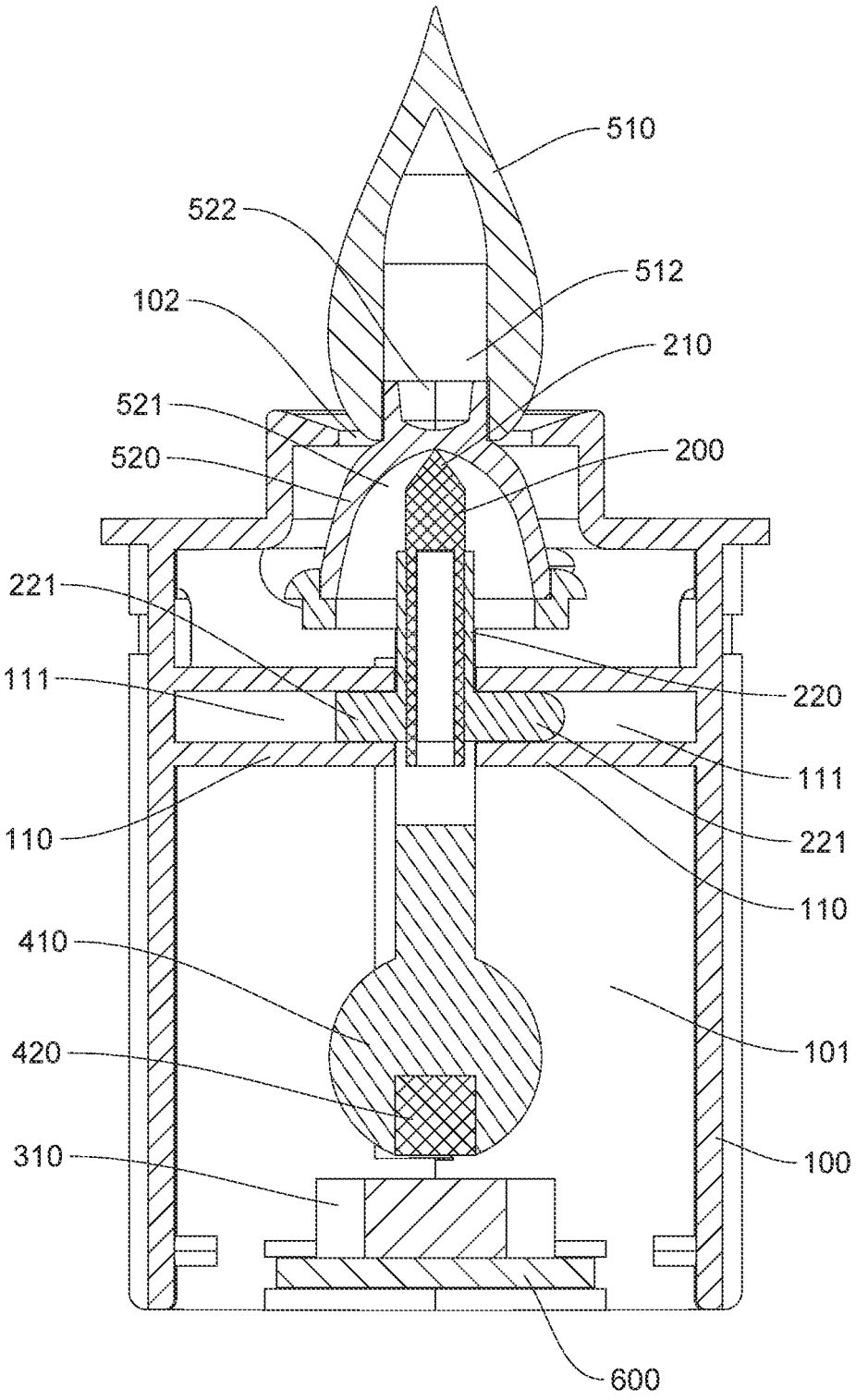
FIG. 4 is another sectional view of the electronic candle in FIG. 1.

In another embodiment of the present invention, referring to FIG. 2, FIG. 3, and FIG. 4, the flame head 500 includes a flame portion 510. The flame portion 510 at least partially extends out of the opening 102. The lower end of the flame portion 510 is provided with a swinging portion 520, and the lower end of the swinging portion 520 is provided with a recessed portion 521. The top portion of the light source 200 is provided with the supporting end 210. The recessed portion 521 is mounted on the light source 200 and abuts against the supporting end 210, which serves a supporting function. The supporting end 210 supports the recessed portion 521 in such a way that the recessed portion 521 can swing freely on the supporting end 210 while being supported thereby and in turn drive the flame portion 510 to swing freely on the supporting end 210, the objective being for the flame portion 510 to produce a visual effect that simulates the swinging of a flame.

In the foregoing embodiments, referring to FIG. 2, FIG. 3, and FIG. 4, the recessed portion 521 has a curved recess, and the supporting end 210 may be a conical pointed end 210*a*, with the pointed portion of the conical pointed end 210*a* abutting against the wall of the curved recess, and the conical pointed end 210*a* serving a supporting purpose. When the recessed portion 521 is supported by the conical pointed end 210*a*, the contact area between the conical pointed end 210*a* and the wall of the curved recess is relatively small, which leads to relatively low friction and relatively low resistance such that the flame head 500 can swing on the conical pointed end 210*a* in an easy, smooth, and natural manner.

In another embodiment, the recessed portion 521 still has a curved recess, but the supporting end 210 is a curved end 210*b* instead. The curved end 210*b* abuts against the wall of the curved recess and serves a supporting purpose. When the recessed portion 521 is supported by the curved end 210*b*, the contact area between the curved end 210*b* and the wall of the curved recess is relatively large such that the curved end 210*b* can support the flame head 500 stably and allow the flame head 500 to swing stably on the curved end 210*b*.

Furthermore, the swinging portion 520 is made of a light-permeable material, and the swinging portion 520 is hemispherical, has the recessed portion 521, and therefore forms a concave lens 520*a*. The light emitted by the light source 200 is projected upward through the swinging portion 520 onto the flame portion 510. Now that the swinging portion 520 is a concave lens 521*a*, which can diverge, or scatter, light, the light emitted by the light source 200 is projected on the flame portion 510 in a diverging or scattered manner, which helps the flame portion 510 emit light evenly and thereby produce a desirable visual effect.

In some embodiments, the supporting end 210 is integrally formed with the light bead to facilitate manufacture and enhance structural robustness.

Figure 5:
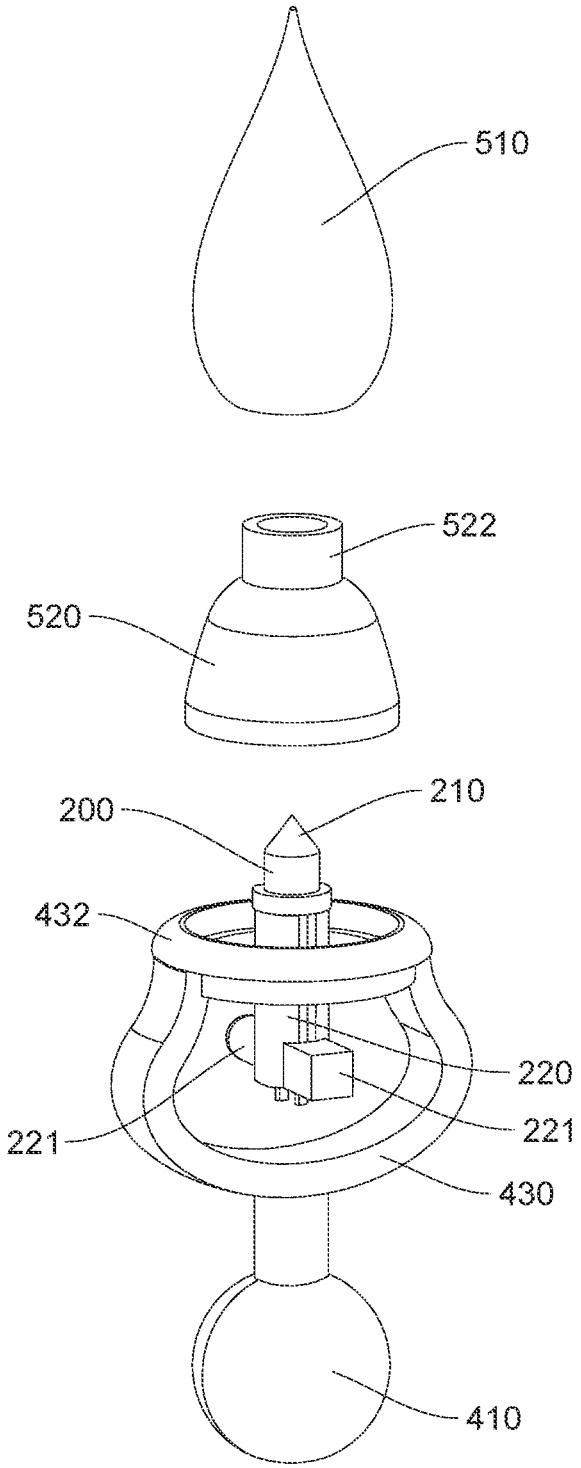
FIG. 5 is a partial exploded view of the electronic candle in FIG. 1.

Furthermore, as shown in FIG. 3, FIG. 4, and FIG. 5, each of the upper end of the swinging portion 520 and the lower end of the flame portion 510 is provided with one or the other of an insertion post 522 and an insertion groove 512. The insertion post 522 matches the insertion groove 512 and can be inserted in and thus connected to the insertion groove 512 so that the swinging portion 520 and the flame portion 510 can be rapidly connected and easily put together by inserting the insertion post 522 into the insertion groove 512.

In some embodiments, the insertion post 522 is provided at the upper end of the swinging portion 520, and the insertion groove 512 is provided at the lower end of the flame portion 510, thereby allowing the swinging portion 520 and the flame portion 510 to be rapidly connected by inserting the insertion post 522 into the insertion groove 512.

In some other embodiments, the insertion post 522 is provided at the lower end of the flame portion 510, and the insertion groove 512 is provided at the upper end of the swinging portion 520 to enable rapid connection between the swinging portion 520 and the flame portion 510 by inserting the insertion post 522 into the insertion groove 512.

Furthermore, the flame head 500 is made of a light-permeable material so that the light emitted by the light source 200 can pass through the flame head 500 to produce the effect that the flame head 500 resembles a real flame.

Furthermore, the swinging portion 520 is generally semi-spherical, and the flame portion 510 is generally in the shape of a water drop.

In another embodiment of the present invention, referring to FIG. 2, FIG. 3, and FIG. 4, the swinging support member 400 includes a counterweight block 410 connected to the swinging portion 520 of the flame head 500. The lower end of the counterweight block 410 is centrally provided with at least one to-be-drawn member 420. The material of the to-be-drawn member 420 is either a magnet or a metal that can be attracted to a magnet.

As shown in FIG. 2, FIG. 3, and FIG. 4, the driving component 300 includes an electromagnetic driving element 310. The electromagnetic driving element 310 generates an intermittent magnetic field. Each time the magnetic field is generated, the to-be-drawn member 420 is drawn by the magnetic field and in turn drives the counterweight block 410 into a swinging motion. During the intervals in which the counterweight block 410 is not driven by the to-be-drawn member 420 (or by the electric field generated by the electromagnetic driving element 310 to be exact), the counterweight block 410 swings freely due to the gravitational force acting on itself and thus drives the flame head 500 to swing freely on the light source 200, allowing the flame head 500 to swing in a natural and dynamic manner. The electromagnetic driving element 310 is a mature prior art and generates a magnetic field when supplied with electricity.

More specifically, referring to FIG. 2, FIG. 3, and FIG. 4, the electromagnetic driving element 310 generates an intermittent magnetic field (or periodic magnetic field); in other words, the magnetic field is generated at intervals. The electromagnetic driving element 310 generates the magnetic field when in driving operation, and the magnetic field attracts the to-be-drawn member 420 magnetically such that the counterweight block 410 is driven to swing. When the electromagnetic driving element 310 temporarily stops operation, the magnetic field disappears, and then the counterweight block 410 swings freely due to the gravitational force acting on itself and thereby drives the flame head 500 to swing on the light source 200 either freely or like a pendulum. The flame head 500, therefore, can swing in a smooth and natural manner to produce a visual effect that simulates a swinging flame.

For example, referring to FIG. 2, FIG. 3, and FIG. 4, the electromagnetic driving element 310 generates an intermittent magnetic field (or periodic magnetic field), and the intermittent magnetic field is generated every 10 seconds and lasts 0.5 second each time it is generated. The magnetic field applies an attractive force to the to-be-drawn member 420 on the counterweight block 410, and the attractive force drives the counterweight block 410 to swing. After the 0.5 second duration of the magnetic field, the electromagnetic driving element 310 stops operation, so the magnetic field disappears. The counterweight block 410 then swings freely or like a pendulum as a result of the gravitational force acting on itself, thereby driving the flame head 500 to swing freely. The freely swinging flame head 500 and counterweight block 410 will keep swinging under gravity (which is a force of nature) until the counterweight block 410 is once again driven to swing by the magnetic field intermittently generated by the electromagnetic driving element 310. The foregoing process repeats itself such that a swinging effect resembling a naturally swinging flame is achieved with a high degree of simulation.

The time interval at which the intermittent magnetic field is generated and the duration of each occurrence of the magnetic field can be determined according to practical production requirements; this embodiment has no limitation in those regards.

Furthermore, as shown in FIG. 2, FIG. 3, and FIG. 4, a receiving groove is provided in a central portion of the lower end of the counterweight block 410 so that the to-be-drawn member 420 can be easily installed by being fixedly inserted in and thus connected to the receiving groove.

Furthermore, as shown in FIG. 2, FIG. 3, and FIG. 4, the counterweight block 410 is generally spherical so as to produce a desirable swinging effect.

Furthermore, as shown in FIG. 2, FIG. 3, and FIG. 4, the upper end of the counterweight block 410 is provided with a connecting portion 430. The upper end of the connecting portion 430 is connected to the flame head 500. The connecting portion 430 is formed with a clearance hole 431 for providing clearance for the light source 200. The clearance hole 431 is provided to prevent the connecting portion 430 from contacting the light source 200 when the connecting portion 430 is swinging along with the counterweight block 410, and to thereby ensure that the flame head 500 and the counterweight block 410 can swing freely.

Furthermore, as shown in FIG. 3, FIG. 4, and FIG. 5, the upper end of the connecting portion 430 is provided with a connection ring 432. The light source 200 extends through, and is provided at, the center of an annular engaging groove 432*a* of the connection ring 432. The lower end of the swinging portion 520 of the flame head 500 is fixedly inserted in and thus connected to the annular engaging groove 432*a* of the connection ring 432. The foregoing configuration facilitates both assembly and manufacture.

In another embodiment of the present invention, referring to FIG. 2, FIG.3, and FIG. 4, the lower end of the light source 200 is provided with a support frame 220. The support frame 220 is fixedly mounted in the mounting cavity 101. The light source 200 is fixedly mounted in the support frame 220 by, for example, mechanical engagement or an adhesive bond. Both the light source 200 and the support frame 220 are provided vertically and are aligned with the flame head 500 in order for the light source 200 to support the flame head 500 stably.

Furthermore, as shown in FIG. 2, FIG. 3, and FIG. 4, the peripheral wall of the support frame 220 is protrudingly provided with at least one insertion and connection post 221, and the wall of the mounting cavity 101 is provided with at least one connection post 110. The connection post 110 is provided with an insertion and connection hole 111. The insertion and connection post 221 is fixedly inserted in and thus connected to the insertion and connection hole 111 such that the support frame 220 and the light source 200 are fixedly mounted in the mounting cavity 101. The foregoing configuration enables easy assembly.

Furthermore, in order to mount the support frame 220 and the light source 200 even more securely in the mounting cavity 101, each of two opposite portions of the peripheral wall of the support frame 220 may be protrudingly provided with one insertion and connection post 221, and each of two opposite portions of the wall of the mounting cavity 101 may be protrudingly provided with one connection post 110. With each of the two insertion and connection posts 221 fixedly inserted in and thus connected to the insertion and connection hole 111 of the corresponding one of the two connection posts 110, the support frame 220 and the light source 200 can be mounted more firmly than only one insertion and connection post 221 and only one connection post 110 are provided.

In another embodiment of the present invention, referring to FIG. 1 to FIG. 3, the casing 100 includes a first casing portion 120 and a second casing portion 130 fittingly fastened to the first casing portion 120. The mounting cavity 101 and the opening 102 are formed between the first casing portion 120 and the second casing portion 130. Providing the casing 100 as assembled from the first casing portion 120 and the second casing portion 130 makes it easier for an assembly worker to mount the light source 200, the driving component 300, the swinging support member 400, and the flame head 500 in the mounting cavity 101.

More specifically, the first casing portion 120 and the second casing portion 130 may be connected by mechanical engagement, insertion-based connection, threaded connection, or other connection means.

In another embodiment of the present invention, referring to FIG. 2, FIG. 3, and FIG. 4, the electronic candle further includes an electrical control device 600, and both the light source 200 and the driving component 300 are electrically connected to the electrical control device 600. Depending on actual production requirements, the electrical control device 600 may be implemented by a programmable logic controller (PLC), an integrated chip, or an integrated circuit board. As the electrical control device 600 is a technically well-developed and mature prior art, a person skilled in the art shall be able to understand how the electrical control device 600 controls the operation of the electronic candle, and a description of the control principle of the electrical control device 600 is therefore omitted.

In another embodiment of the present invention, the mounting cavity 101 is further provided therein with a battery (not shown). The battery is electrically connected to the electrical control device 600 and supplies electricity to the light source 200 and the driving component 300.

The remaining portion of this embodiment is the same as its counterpart in the first embodiment. All the undescribed features in this embodiment can be understood by referring to the description of their counterparts in the first embodiment and therefore will not be described repeatedly.

The above description is only the preferred embodiments of the present invention and is not intended to limit the present invention in any form. Although the invention has been disclosed as above in the preferred embodiments, they are not intended to limit the invention. A person skilled in the relevant art will recognize that equivalent embodiment modified and varied as equivalent changes disclosed above can be used without parting from the scope of the technical solution of the present invention. All the simple modification, equivalent changes and modifications of the above embodiments according to the material contents of the invention shall be within the scope of the technical solution of the present invention.

What is claimed is:

1. An electronic candle, comprising: a casing, a light source, a driving component, a swinging support member, and a flame head, wherein the casing has a mounting cavity, the casing has an upper end provided with an opening in communication with the mounting cavity, both the light source and the driving component are mounted in the mounting cavity, the light source is located directly below the opening, the flame head is movably mounted on the light source and is able to swing freely on a supporting end provided or defined by the light source, the flame head at least partially extends out of the opening, the swinging support member and the flame head are connected to each other, and the driving component is configured to drive the swinging support member to swing, thereby driving the flame head to swing freely on the light source;

wherein the flame head comprises a flame portion, the flame portion at least partially extends out of the opening, the flame portion has a lower end provided with a swinging portion, the swinging portion has a lower end provided with a recessed portion, the light source has a top portion provided with the supporting end, and the recessed portion is mounted on the light source, abuts against the supporting end, is supported by the supporting end, and is able to swing freely on the supporting end;

wherein an upper end of the swinging portion and the lower end of the flame portion are each provided with one or the other of an insertion post and an insertion groove, and the insertion post matches the insertion groove and is inserted in and thus connected to the insertion groove.

2. The electronic candle of claim 1, wherein the supporting end is a conical pointed end or a curved end, and the conical pointed end or the curved end abuts against an inner wall of the recessed portion.

3. The electronic candle of claim 1, wherein the swinging portion is made of a light-permeable material, and the swinging portion is semispherical, has the recessed portion, and thus forms a concave lens.

4. The electronic candle of claim 1, wherein the swinging support member comprises a counterweight block connected to the flame head, the counterweight block is provided with at least one to-be-drawn member, a material of the to-be-drawn member is a magnet or a metal attractable to a magnet, the driving component comprises an electromagnetic driving element, the electromagnetic driving element generates an intermittent magnetic field, and the magnetic field draws the to-be-drawn member and thereby drives the counterweight block to swing.

5. The electronic candle of claim 4, wherein the counterweight block has an upper end provided with a connecting portion, the connecting portion has an upper end connected to the flame head, and the connecting portion is formed with a clearance hole for providing clearance for the light source.

6. The electronic candle of claim 5, wherein the upper end of the connecting portion is provided with a connection ring, the light source extends through, and is provided at, a center of an annular engaging groove of the connection ring, and the flame head has a lower end inserted in and thus connected to the annular engaging groove of the connection ring.

7. The electronic candle of claim 1, wherein the light source has a lower end provided with a support frame, and the support frame is fixedly mounted in the mounting cavity.

8. The electronic candle of claim 7, wherein the support frame has a peripheral wall protrudingly provided with at least one insertion and connection post, the mounting cavity has a wall provided with at least one connection post, the connection post is provided with an insertion and connection hole, and the insertion and connection post is fixedly inserted in and thus connected to the insertion and connection hole.

9. The electronic candle of claim 8, wherein each of two opposite portions of the peripheral wall of the support frame is protrudingly provided with a said insertion and connection post, each of two opposite portions of the wall of the mounting cavity is protrudingly provided with a said connection post, and each of the two insertion and connection posts is fixedly inserted in and thus connected to the insertion and connection hole of a corresponding one of the two connection posts.

* * * * *